US006212804B1

(12) United States Patent
Richard

(10) Patent No.: US 6,212,804 B1
(45) Date of Patent: Apr. 10, 2001

(54) HYDRAULICALLY OPERATED DECORATIVE BIRD SCULPTURE

(75) Inventor: Christopher Clay Richard, Chicago, IL (US)

(73) Assignee: Henri Studio, Inc., Wauconda, IL (US)

( * ) Notice: Subject to any disclaimer, the term of this patent is extended or adjusted under 35 U.S.C. 154(b) by 0 days.

(21) Appl. No.: 09/574,497

(22) Filed: May 19, 2000

(51) Int. Cl.[7] ..... G09F 19/00
(52) U.S. Cl. ..... 40/406; 40/407; 40/411
(58) Field of Search ..... 40/406, 407, 416, 40/411, 412, 439; 239/17, 20

(56) References Cited

U.S. PATENT DOCUMENTS 803,084 * 10/1905 Alexander ..... 239/20
1,952,353 * 3/1934 Barclay ..... 239/20
3,318,528 * 5/1967 Williams ..... 239/20
5,367,805 * 11/1994 Bates ..... 40/406

FOREIGN PATENT DOCUMENTS

639450 * 6/1928 (FR) ..... 40/416

* cited by examiner

*Primary Examiner*—Joanne Silbermann
(74) *Attorney, Agent, or Firm*—Jones, Day, Reavis & Pogue

(57) ABSTRACT

A novel decorative bird sculpture has a main body portion with a neck and head extending therefrom. An upper and a lower beak portion extends from the head, the lower beak portion being pivotably connected to the head. A conduit runs from an electrically operated pump and reservoir arrangement and discharges into a proximal portion of the beak thereby causing the beak to open by downward pivoting of the lower beak portion and discharging water back into the reservoir. In another aspect of the invention the head may be pivotably mounted on the neck in such a way as to also pivot downwardly as water fills the beak.

10 Claims, 5 Drawing Sheets

HYDRAULICALLY OPERATED DECORATIVE BIRD SCULPTURE

BACKGROUND OF THE INVENTION

1. Field of the Invention

The present invention relates generally to a decorative bird sculpture and, more particularly, to a bird sculpture having a fluid operated pivotable head and beak.

2. Description of the Related Art

Virtually everyone in society has at least some interest in or appreciation of art in various forms. One form of art that has been known since early antiquity is sculpture or statuary. In modem times sculptures and statuary can often be purchased at reasonable prices to decorate a person's surroundings such as a home or even a place of business.

Many people find it aesthetically pleasing to decorate their homes and places of business with gardens. In such cases statuary or sculptures are frequently used for artistic effect to complement other garden features. Often a small pond, for example, can be a highly desirable feature of a decorative garden, and the pond may be further enhanced in aesthetic appearance with the use of a fountain sculpture. A typical fountain sculpture may be placed in a pond or other reservoir and may be provided with an electrically operated pump to recirculate water through the sculpture from the pond or reservoir lending the appearance of an endless flow of water through the sculpture.

Decorative devices are known which have moving parts that are operated by flowing water. Often such devices can be fascinating to watch. One such device is disclosed in U.S. Pat. No. 5,367,805 issued to Bates. Illustrated therein is a hand pump with an internal cup attached to the pump handle. As the cup is filled with water the handle pivots until the cup is dumped and the water exits the pump spout into a reservoir where it is recirculated by a small electrically operated pump back up to the cup. The recirculation of the water lends the impression that the device has an endless supply of water that is being pumped by the moving handle.

It is thus desirable to provide a novel aesthetically pleasing sculpture that can be used, for example, to decorate a garden. It is further desirable to provide such a sculpture which has moving parts that are operated hydraulically. Still further it is desirable to provide such a sculpture that employs a pump and reservoir arrangement to recirculate water through the sculpture lending the impression that the moving parts of the sculpture are operated by an endless supply of water.

SUMMARY OF THE INVENTION

The present invention provides a novel decorative bird sculpture having a main body portion with a neck and head extending therefrom. An upper and a lower beak portion extends from the head, the lower beak portion being pivotably connected to the head. A conduit runs from an electrically operated pump and reservoir arrangement and discharges into a proximal portion of the beak thereby causing the beak to open by downward pivoting of the lower beak portion and discharging water back into the reservoir. In another aspect of the invention the head may be pivotably mounted on the neck in such a way as to also pivot downwardly as water fills the beak.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
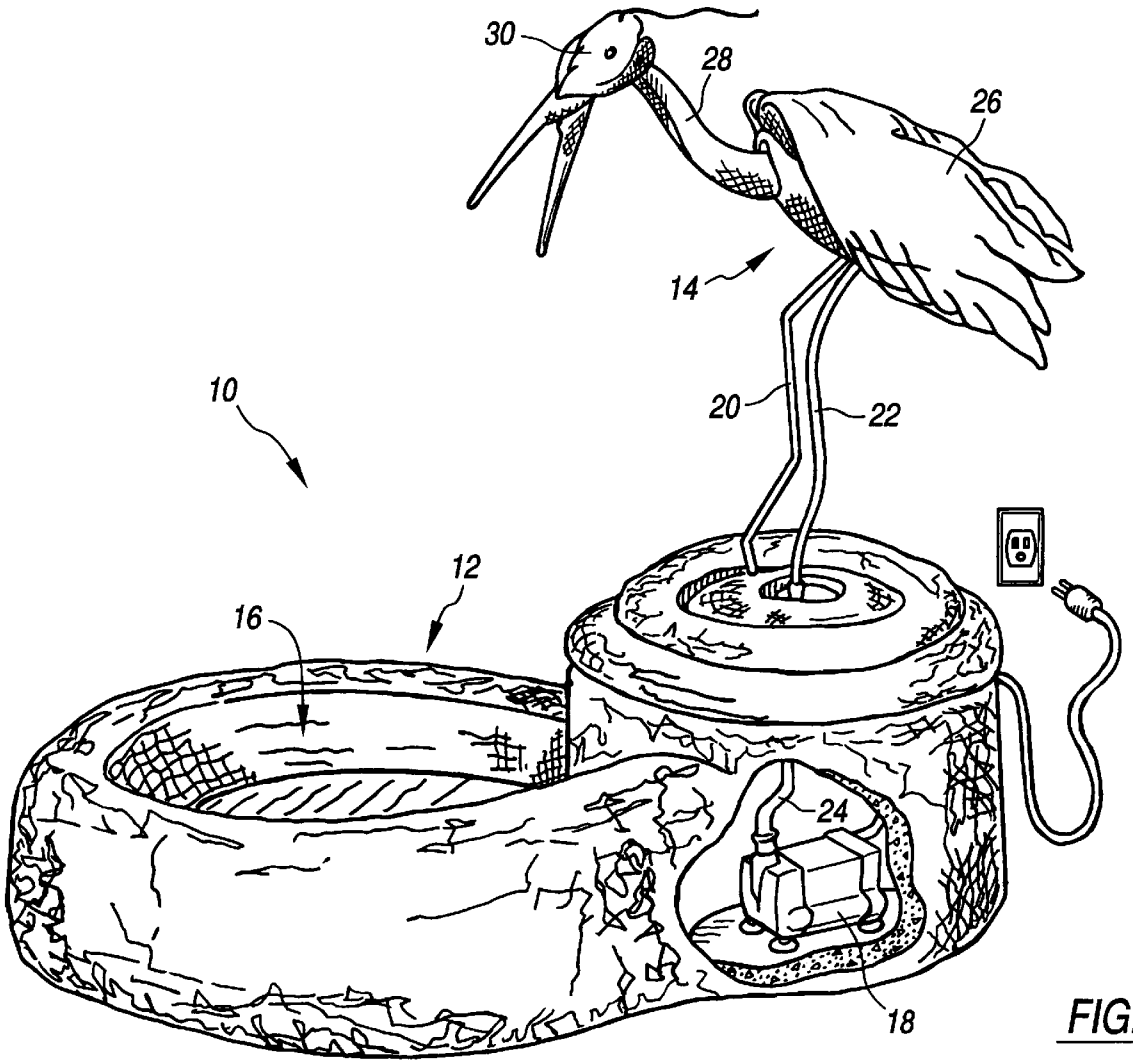
FIG. 1 is a perspective view, partially broken away, of a sculpture constructed in accordance with the principles of the invention.

Referring now to the drawings, and initially to FIG. 1, a decorative bird sculpture suitable for practicing the principles of the invention is shown in side perspective view and designated generally by the reference numeral 10. The sculpture 10 includes as its principal components a base assembly 12 and a bird figurine 14 supported on the base assembly 12. While the bird figurine 14 is shown as resembling an egret, it will be appreciated that the figurine can be fashioned into other bird-like forms such as a heron or stork for example. The base assembly 12 is configured to form a reservoir 16 for containing a quantity of fluid, preferably water. The reservoir 16 extends underneath the figurine 14 wherein there is provided a submersible electric pump 18. The figurine 14 is provided with a pair of legs 20 and 22 of which at least one leg 22 is formed of a tube connected by a hose 24 to the pump 18. The figurine 14 includes a body portion 26 from which a neck portion 28 and head portion 30 extend. Although not seen, the tubular leg 22 extends up through the body portion 26 and neck portion 28 and thence into the head portion 30, for purposes of which will be described in detail hereinafter.

Figure 2:
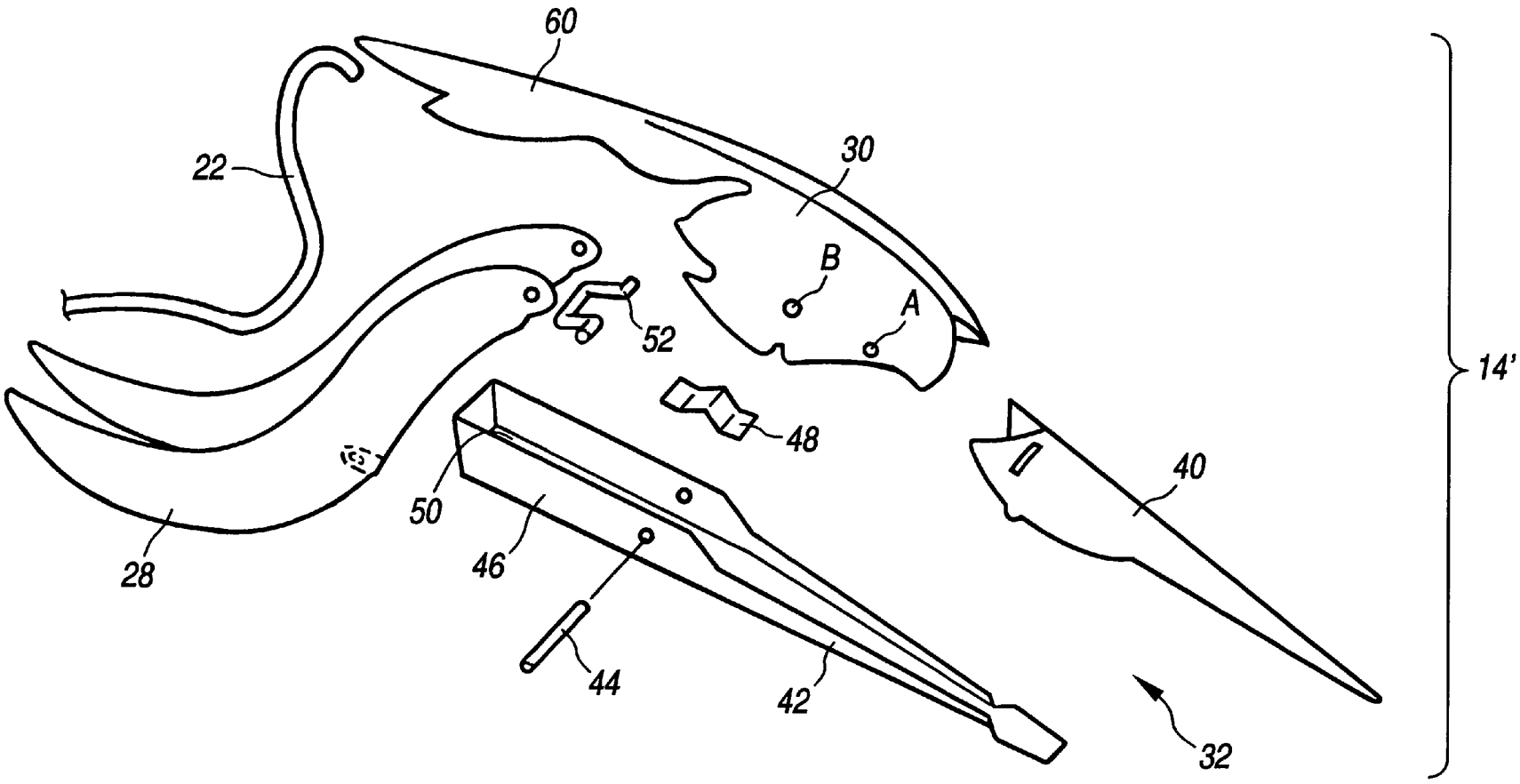
FIG. 2 is an exploded perspective view of an upper portion of the bird figurine shown in FIG. 1.

Turning now to FIG. 2 which shows an exploded view of the component parts of the upper figurine 14', a beak 32 can be seen as comprising an upper beak portion 40, which is preferably immovably fixed to the head portion 30, and a lower beak member 42. The lower beak member 42 is attached by a pin 44 at a pivot point A provided on the head portion 30. The lower beak member 42 may be generally V-shaped in cross-section. A portion 46 of the lower beak member 42 proximal to the pivot point A is provided with a dam element 48 which creates a small reservoir 50, the purpose of which will hereinafter be explained.

In another aspect of the invention, the head portion 30 is pivotably connected to the neck portion 28 at a pivot point B by an axle 52. The axle 52 is generally U-shaped such that it receives the proximal end 46 of the beak member 42 and allows clearance for the beak member 42 to pivot.

Figure 3:
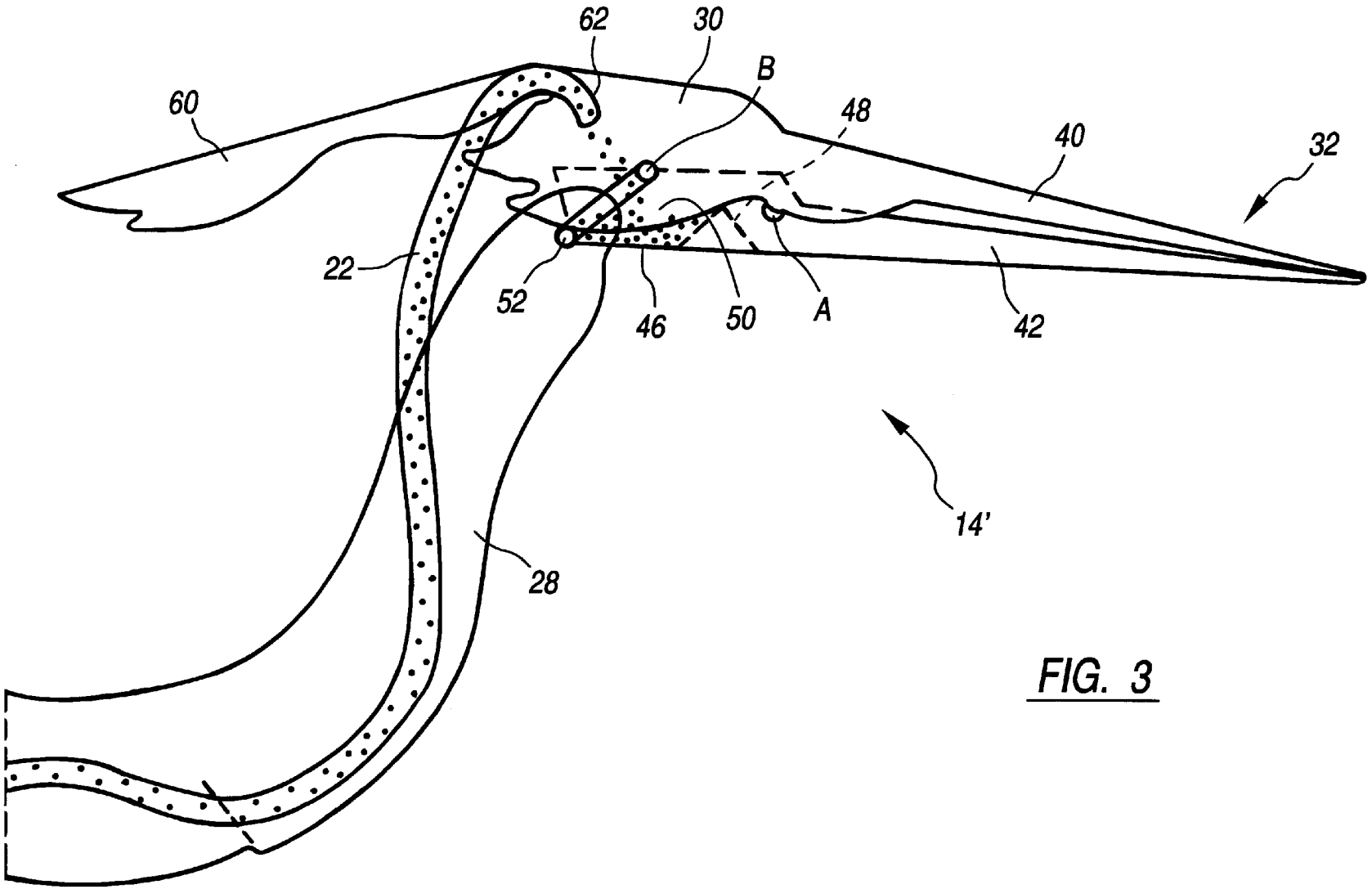
FIG. 3 is a side schematic view of the assembled upper portion of the figurine shown in an initial operative state.
Figure 4:
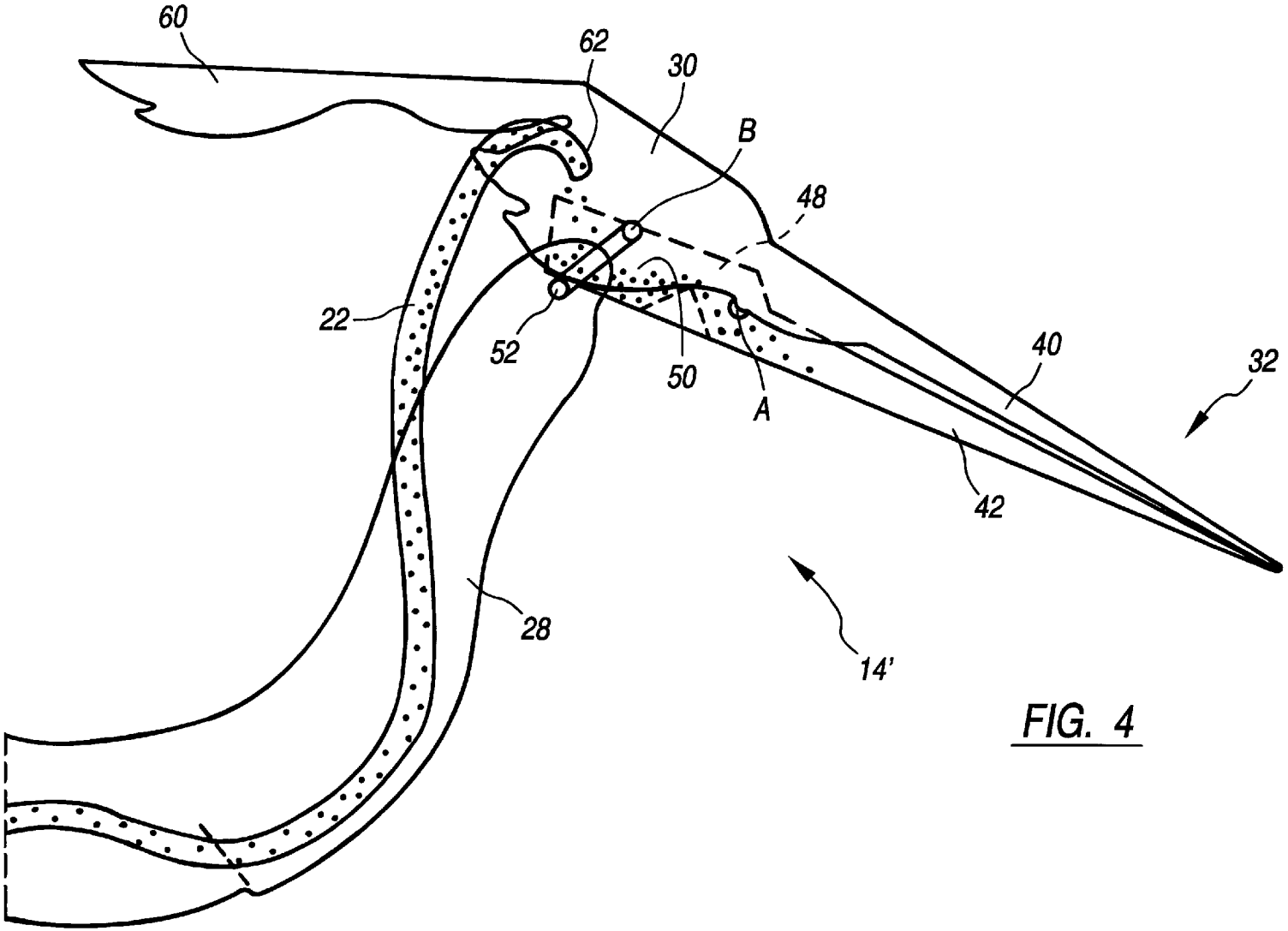
FIG. 4 is a side schematic view of the assembled upper portion of the figurine shown in an intermediate operative state.
Figure 5:
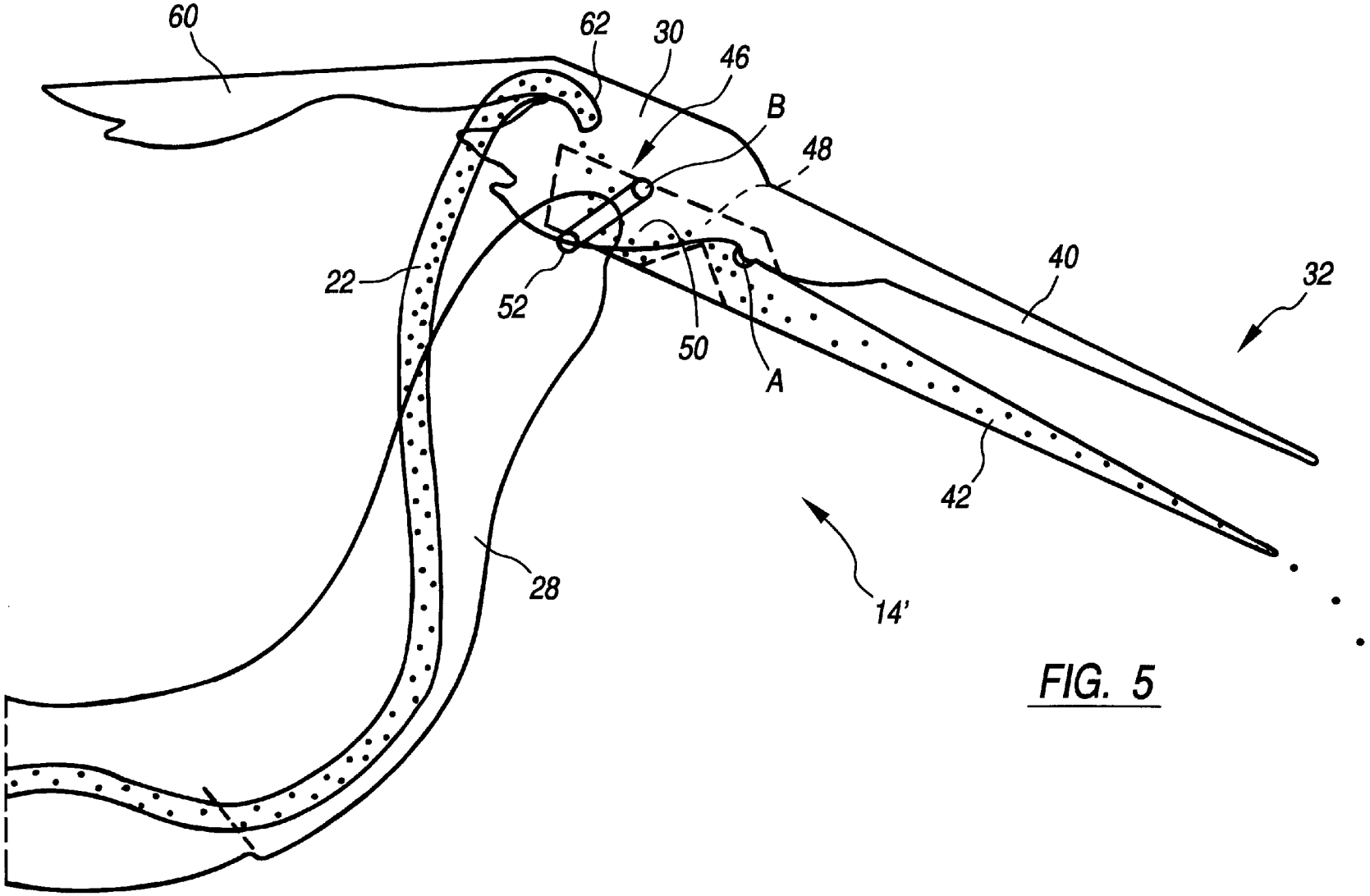
FIG. 5 is a side schematic view of the assembled upper portion of the figurine in a final operative state.

Operation of the sculpture 10 can best be appreciated with reference to FIGS. 3–5. FIG. 3 illustrates an upper portion of the figurine 14' with the head portion 30 in an unpivoted, generally horizontal condition. The position shown is essentially dictated by the geometry of the head portion 30 and the location of the head pivot point B. A suitable plume portion 60 may be provided as a counterbalance. In FIG. 3, the tube 22 is shown as having a discharge end 62 which, when the pump 18 is operational, provides a small stream of water to fill the reservoir 50 at the proximal portion 46 of the lower beak member 42.

FIG. 4 shows the upper portion of the figurine 14' with the small reservoir 50 being filled with water causing the head portion 30 to pivot downwardly and the water to begin to overflow the dam element 48 into a main part of the lower beak member 42. In succession and as shown in FIG. 5, the lower beak member 42 next fills with water causing the beak member 42 to pivot downwardly about pivot point A. With the beak 32 thus open, water flows out of the lower beak member 42 and into the reservoir 16 where it is recirculated by the pump 18. The head and beak portions 30 and 40 then return to the position shown in FIG. 3 and the process begins once again.

It can now be appreciated that sculpture 10 constructed in accordance with the invention offers considerable advantages in serving as a desirable ornamental piece particularly in decorative gardens. The continuous movement of the figurine 14 lends a fascinating appearance to the sculpture 10 which can captivate the attention of any onlooker. It can also be appreciated that the sculpture 10 can be readily constructed using conventional materials and manufacturing techniques. For example, the tube 22 can be a standard copper tube that is formed to appear leg-like at its exposed portion. Moreover, the figurine 14 can be sculpted of copper or brass sheet material so as to be resistant to corrosion.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A decorative bird sculpture comprising:

a main body portion;

a neck portion extending generally upwardly from said body portion;

a head portion connected to said neck portion;

an upper beak portion extending from said head portion;

a lower beak portion extending from said head portion and being aligned with said upper beak portion, said lower beak portion being pivotably connected to said head portion;

conduit means having a discharge end disposed in said head portion for discharging a fluid into a proximal portion of said lower beak portion; and means for pumping fluid through said conduit means and into said proximal portion of said lower beak portion wherein said lower beak portion is caused to pivot downwardly under the weight of fluid and discharge fluid from said head portion.

2. The sculpture of claim 1 wherein said means for pumping includes an electrically operated pump.

3. The sculpture of claim 1 wherein said means for pumping is disposed in a fluid reservoir.

4. The sculpture of claim 3 wherein said lower beak portion is configured to discharge fluid into said reservoir.

5. The sculpture of claim 4 wherein fluid is recirculatable from said reservoir to said discharge end of said conduit means.

6. The sculpture of claim 1 wherein said lower beak portion includes a dam member dimensioned and configured to cause fluid discharged from said conduit means to pool within said proximal portion of said lower beak portion.

7. The sculpture of claim 6 wherein said head portion is pivotably connected to said neck portion and pooling of fluid within said proximal portion of said lower beak portion causes said head portion to pivot downwardly.

8. The sculpture of claim 7 wherein said dam member is configured to permit said head portion to pivot downwardly under the weight of fluid and allow fluid thereafter to flow into a distal lower beak portion causing said lower beak portion to pivot downwardly.

9. The sculpture of claim 1 wherein said lower beak portion is generally V-shaped in cross-section.

10. The sculpture of claim 1 wherein said head portion is pivotably connected to said neck portion.

* * * * *